United States Patent [19]

Koziol et al.

[11] 3,948,752

[45] Apr. 6, 1976

[54] ELECTRODE FOR ELECTROCHEMICAL PROCESS

[75] Inventors: Konrad Koziol, Rothenbach an der Pegnitz; Karl-Heinz Sieberer, Zirndorf uber Nurnberg; Hans-Carl Rathjen, Rothenbach an der Pegnitz, all of Germany

[73] Assignee: Firma C. Conradty, Nurnberg, Germany

[22] Filed: Nov. 13, 1973

[21] Appl. No.: 415,421

[30] Foreign Application Priority Data

Nov. 14, 1972 Germany ..... 2255690

[52] U.S. Cl. ..... 204/290 F; 204/290 R; 423/593

[51] Int. Cl.[2] ..... C25B 11/08; C25B 11/10

[58] Field of Search ..... 204/290 F, 290 R; 423/593

[56] References Cited

UNITED STATES PATENTS

| | | | |
|---|---|---|---|
| 3,451,856 | 6/1969 | Fraase et al. | 136/120 FC |
| 3,491,014 | 1/1970 | Binnedic et al. | 204/242 |
| 3,649,485 | 3/1972 | Chisholm | 204/95 |
| 3,711,397 | 1/1973 | Martinson | 204/290 F |
| 3,801,490 | 4/1974 | Welch | 204/290 F |
| 3,804,740 | 4/1974 | Welch | 204/290 R |

FOREIGN PATENTS OR APPLICATIONS

| | | | |
|---|---|---|---|
| 1,506,040 | 12/1967 | France | 423/593 |
| 77,963 | 12/1970 | Germany | 204/290 F |

*Primary Examiner*—F. C. Edmundson
*Attorney, Agent, or Firm*—Shlesinger, Arkwright, Garvey & Dinsmore

[57] ABSTRACT

An electrode for electrochemical processes, particularly for the electrolysis processes for manufacturing chlorine, consisting of a metal resistant to the electrolysis medium and of an active cover layer applied thereon and containing the substances causing the electrode process, which substances are compounds of the type $Pt_xM_yM_zO_2$, $Pd_xM_yM_zO_2$ being of rhombohedral crystal structure, and of the type $A_xPt_3O_4$, $A_xPd_3O_4$ which in connection with the other compounds can be regarded as Perowskistructure. On account of the marked non-stoichiometry proper to these compounds, excess electrons occur, resulting in the low electrical resistance which is characteristic for said compounds and which is in the same range as that of some of the metals.

3 Claims, 2 Drawing Figures

ELECTRODE FOR ELECTROCHEMICAL PROCESS

BACKGROUND OF THE INVENTION

Figure 1:
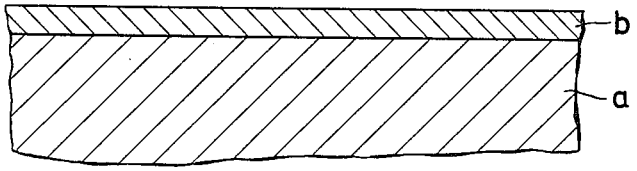

The present invention relates to an electrode for electrochemical processes, particularly for the electrolysis processes to produce chlorine, consisting of a metal resistant to the electrolysis medium and an active cover layer applied thereon, said layer containing the substances producing the electrode process.

Technical anode materials have to meet a number of requirements. For reasons of durability, the anode material must not only be sufficiently corrosion-resistant, but it must also be possible to carry out the anode process at sufficiently high speed. In the case of coated electrodes, the electron conductivity of the anode core and the surface layer, due to energy reasons, must be high and the excess voltage of the anode process must be low. Possible corrosion products of the anode may not disturb the normal operating course of the electrolysis process. Furthermore, the anode material should of course be inexpensive.

The conventional electrodes only partially meet these stringent requirements.

Platinum, platinum metal and their alloys have for a long time been known as resistant electrode materials. For example, the first horizontal mercury cells for electrolytically obtaining chlorine and soda lye were equipped with anodes of platinum and platinum-/iridium. On account of the high costs for equipping with platinum wire anodes and last but not least also on account of the considerably high corrosion rates of the valuable precious metal — the specific platinum loss was, even with the still very low plate current densities of that time, already at between 0.3 and 0.6 g platinum per ton of chlorine produced — it soon became necessary to change over to the more economical graphite anodes.

The idea to coat with platinum a non-precious base metal, such as copper, iron etc., in order to thus attain an inexpensive anode material is also already quite old. However, in the field of chlorine, alkali electrolysis, these platinized metal anodes very soon succumbed to the corrosive effect of the cell media.

Finally over the past few years anodes have become known, the base body of which consists of a non-precious metal that can be passivated, for example titanium, tantalum, zirconium, niobium, and the active cover layer of which consists of a platinum metal or a platinum metal alloy. It has also meanwhile become known that these metal anodes as well as their plated predecessors are not suited for use in amalgam cells. For their expensive precious metal plating in the long run cannot cope with the numerous intensive loads of mechanical, electrical, chemical and electrochemical nature that are prevalent in the present-day giant cells. The effectiveness of the platinum metal layer kept thin for reasons of cost very soon deteriorates which on the one hand results in constant voltage increases and on the other hand requires frequent anode exchange. A sudden failure of the entire metal anode line-up will necessarily have to be expected in the case of the horizontal mercury cell which has meanwhile found wide acceptance; it is well known, that with it the danger of a short circuit is particularly great and any contact in it with the mercury will immediately remove the platinum metal of the coating due to the fact that it readily amalgamates, thus making the anode inactive at this location.

Moreover, electrodes have become known, the cover layer of which consists of binary oxides or of the mixture of binary oxides of the platinum metals. Moreover, this cover layer can also still contain up to one-half the amount of the platinum metal oxides provided other oxides that are difficult to reduce or that are refractory. It is a known draw-back of these electrodes that the binary precious metal oxides which are known to readily reduce are reduced to the respective metal in mercury cells on account of the amalgam, so that these anodes involve the same draw-back as the already described anodes that are provided with a cover layer of platinum metal. It is a completely logical consequence that this effect occurs with anodes that are coated with oxides of the platinum metals, which is due to the fact, also already known for a long time, that the platinum metals are also covered with electrically conductive oxidic cover layers during use of the anode. It is unimportant as to whether these oxidic cover layers are formed before or only during use in electrolysis. For example, no improvements were attained with any anodes having cover layers the essential component of which was binary oxides of the platinum metals or their mixtures but, rather they involved the same draw-backs as are known for the anodes having cover layers of platinum metals, which are already known much longer.

Moreover, anodes have become known having cover layers in which the oxides of the platinum metals and the oxides that are difficult to reduce or that are refractory, particularly titanium oxide and tantalum oxide, occur in exactly the reverse combination ratio as in the above mentioned anodes. It is known that titanium dioxide and tantalum pentoxide are excellent electrical insulators, which are entirely unsuited for carrying through an anode process. Although the electrical resistance of said materials can to a certain extent be reduced by doping or by oxygen removal, these materials, however, cannot at all be termed good electrical conductors. A further, even graver draw-back is that oxides of titanium or tantalum that have been made conductive by oxygen removal become good insulators again under oxidizing conditions, as are usual with an anode, which means they become bad electrical conductors.

Furthermore, anodes have become known which have a cover layer containing substances of the type $Me(I)_{ca.\ 0.5}Pt_3O_4$ or consisting of said substances. Although good results have been achieved with this anode when used in electrolysis processes operating with high current load and permitting renewal of the anode coating only at longer time intervals, certain difficulties arise in the manufacturing of anodes to be used in electrolysis processes operating with low current load or, respectively, when the anode coating is renewed within shorter time intervals, because in the latter case very thin cover layers are concerned or, respectively, cover layers containing little $Me(I)_{ca.\ 0.5}Pt_3O_4$. These difficulties were soon recognized and it was suggested to correspondingly increase the electrical activity of the cover layer by materials improving the conductivity, for example carbides, borides or nitrides of titanium, tantalum, zirconium, niobium or mixtures thereof. In such a case, the electrode process is always caused by the substances of the type $Me(I)_{ca.\ 0.5}Pt_3O_4$. On account of the particular preparation, the substances of the type $Me(I)_{ca.\ 0.5}Pt_3O_4$ are incorporated as solids into the cover layer, and the electrode whose cover layers are made up with materials improving conductivity of the type just described exhibit properties not entirely satisfactory for some electrolysis purposes.

DESCRIPTION OF THE INVENTION

It is the object of the invention to develop an electrode of a carrier metal that is resistant during electrolysis operation and of an active cover layer applied thereon, which can cope with the demands made in regard to it and overcomes the draw-backs as indicated. This object is particularily advantageously solved in that according to the invention, the active cover layer of the electrode contains the substances causing the electrode process, namely $$Pt_xM_yM_zO_2,\ Pd_xM_yM_zO_2$$

wherein M is Fe, Co, Ni and Mn with $0.7 \leq x < 1$; $0.7 \leq y < 1$ and $0 \leq z \leq 0.1$ and/or $$A_xPt_3O_4,\ A_xPd_3O_4 \text{ with } A_xTiO_2,\ A_xTiO_3,\ A_xRuO_2,\ A_xRuO_3,\ A_xTaO_3,\ A_xNbO_3,\ A_xMnO_2$$

wherein A is Li, Na, K, Cu, Ag with $0.3 \leq x \leq 0.7$ and mixtures thereof.

The compounds $Pt_xM_yM_zO_2$ and $Pd_xM_yM_zO_2$ are of rhombohedral crystal structure, whereas the structure of compounds $A_xPt_3O_4$, $A_xPd_3O_4$ with the other compounds can be regarded as Perowskistructure. On account of the marked non-stoichiometry proper to these compounds, excess electrons occur, resulting in the low electrical resistance that is characteristic for said compounds, the resistance being in the same range as that of some of the metals. Since compounds $A_xPt_3O_4$, $A_xPd_3O_4$ with $A_xTiO_2$, $A_xTiO_3$, $A_xRuO_2$, $A_xRuO_3$, $A_xTaO_3$, $A_xNbO_3$ and $A_xMnO_2$ are of the same type of structure, these compounds are to a very large extent miscible with one another as solids without a change in crystal structure and without separation phenomena occurring, as can be the case already when adding small percentage amounts of oxides with different crystal structure. A further considerable advantage is that in this case oxides having a conductivity comparable with the conductivity of some of the metals are being mixed, and not electrically conductive oxides and insulators. Moreover, it is a further advantage that in this case it is not doped oxides that are concerned, because here mixing of the oxides with one another can take place from the aspects of the most favourable electrochemical combination without having to put up with a worsening in conductivity on account of deviation of the doping composition required for maximum conductivity, because each of the compounds according to the invention stands out for excellent conductivity.

The compounds of $Pt_xM_yM_zO_2$ and $Pd_xM_yM_zO_2$ as well as the mixtures of $A_xPt_3O_4$ and $A_xPd_3O_4$ with the other mentioned compounds are distinguished by particularly high chemical stability, also under reducing conditions. This is a considerable advantage compared to the simple oxides and oxide mixtures of the platinum metals known so far, because these binary oxides of the platinum metal group known as far can readily be reduced, resulting in a substantial increase in loss of noble metal during electrolysis. It can be considered a further advantage of these compounds that the said compounds, in contrast to the simple oxides of the platinum metals, are thermally stable at considerably higher temperatures. Moreover, said compounds are insoluble in the conventional solvents and are resistant to chemical and electrochemical attacks occurring in chloroalkalielectrolysis.

One of the properties of the compounds $A_xPt_3O_4$ and $A_xPd_3O_4$ is that they cannot be disengaged by vacuum evaporation. It follows from this peculiarity that this method of disengagement is not suited either for the production of mixtures of $A_xPt_3O_4$ and/or $A_xPd_3O_4$ with the other said materials.

The high stability of said materials also permits to additionally use to a large extent binary oxides of inexpensive platinum metals. For example, ruthenium oxide can be added to the platinum compounds according to the invention with only a slight worsening of the properties. It is known that ruthenium oxide will readily reduce, and the high chemical stability of the said platinum compounds will remedy this. The use of the oxides of the other platinum metals or of the metals proper results in no substantial worsening either for as long as the condition is complied with that the proportion of these elements is always less than the platinum-/palladium-proportion in the compounds.

These extraordinary properties of the compounds $Pt_xM_yM_zO_2$, $Pd_xM_yM_zO_2$ as well as of the mixtures of $A_xPt_3O_4$ and $A_xPd_3O_4$ with the rest of the compounds mentioned depend to a very large part upon the chemical composition of the compounds. In order to obtain compounds that are as uniform and defined as possible, their disengagement preferably will be effected in a method separate from the actual electrode manufacturing. Application of said compounds onto the carrier metal takes place in a further step.

To show how the compounds of the type $Pt_xM_yM_zO_2$ and $Pd_xM_yM_zO_2$ are prepared, the preparation of compound $Pd_{0.7}Fe_{0.8}O_2$ will be indicated below. This compound relates from the formula of $Pd_xM_xM_zO_2$ for M = Fe; $x = 0.7$; $y = 0.8$ and $z = 0$.

EXAMPLE A

A mixture of 1.242 g palladium (II)-chloride, 7.7 ml 1 n formate iron (II)-oxalate solution and 0.5789 g iron (II, III)-oxide was evaporated to dryness while being continually stirred at 150° C. This ephemeral, very intimate mixture of $PdCl_2$, FeO and $Fe_3O_4$ was slowly heated to 720° C in a quartz crucible in an electrically heated oven under definite partial oxygen pressure. This temperature was maintained for 24 hours. The crucible was then allowed to cool slowly in the oven. The clumped-up burning material was comminuted in the agate mortar and washed with one liter 80° C aqua regia in order to eliminate possibly non-reacted reactants. To eliminate the aqua regia, it was washed with distilled water until the washings no longer became turbid when a silver nitrate solution was added. The washings then were removed by methanol and the resultant product was dried in air. A subsequent 12-hours treatment in the agate crushing container of a centrifugal ball mill comminuted the palladium iron-oxide to less than 1 $\mu$m.

An analysis of the final product showed 49.3 % by weight Pd, 29.5 % by weight Fe and 21.1 % by weight 0. Oxalate ions and chloride ions could not be ascertained. The formula $Pd_{0.703}Fe_{0.801}O_2$ results from this analysis.

The production of the platinum compound was analogous just as the preparation of the compounds with cobalt, nickel, and manganese.

The indicated periods of time may under no circumstances be fallen short of under these test conditions if as complete a reaction as possible of the starting materials and a definite composition of the compound is desired.

The following example is to describe production of the compound $A_xPt_3O_4$ with $A_xNbO_3$, with A = Na.

EXAMPLE B

As starting product for the production of the said compounds, platinum oxide and niobium pentoxide were produced at a desired molar ratio in a nitrate melt, which oxides are provided in most intimately mixed condition due to their common production. Complete reaction to the oxides turned out to be absolutely necessary. These starting products, which were carefully cleaned by washing and thereupon dried, were introduced in finest possible condition into a NaCl-melt, to which cesium chloride had been added up to eutectic mixture in order to lower the melting point. After a halt of more than one day sufficient to complete the reaction, during which the melt and the reaction material had been repeatedly stirred, the melt was allowed to cool. Separation of the salts from the reaction product was effected by resolving the melt cake, and the reaction product was then still further cleaned. The salt could be re-used after evaporation. The reaction product was provided in the composition $Na_{0.55}Pt_3O_4$ with $Na_{0.55}NbO_3$. A radiographic structural test showed the structure expected for this composition.

The other compounds were produced completely analogously.

The production methods indicated in the examples only constitute preferred methods and in no way are intended to restrict the selection as far as preparations can be obtained with the individual methods which are within the indicated limits. Experience has shown that greater deviations from the stoichiometry, as indicated for the respective compounds, result in materials having considerably worse properties and when they are used the economicalness is considerably reduced.

The preparations produced according to the above indicated methods were used in finely milled form. They were applied with binders onto a base of valve metal or an alloy of valve metal.

Such electrodes operated entirely satisfactorily in the NaCl-electrolyte for more than 14 months at a specific anodic current density of $D_A = 10$ kA/m$^2$.

Figure 2:
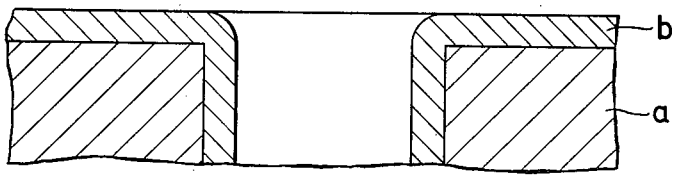

FIGS. 1 and 2 of the enclosed drawing show a sectional view of an embodiment of the structure of the electrodes according to the invention, wherein the metal resistant to the electrolysis medium has been designated by (a) and the active cover layer by (b).

The metal resistant to the electrolysis medium may also have perforations, for example holes.

FIG. 2 shows a sectional view of the structure of the electrode according to the invention at such a perforation.

The following examples are to further make clear, but are in no way to restrict, the manufacturing of the anodes.

EXAMPLE 1

A mixture of 56.33 mole-% $SiO_2$, 10.43 mole-% $CaCl_2$, 9.97 mole-% $B_2O_3$, 9.74 mole-% CuO, 5.10 mole-% $Al_2O_3$, 4.33 mole-% $Li_2CO_3$ and 4.10 mole-% $Pb_3O_4$ is molten in a special crucible oven. After quenching of the liquid melt with water, the thus obtained granulate material of this low-melting binder is mixed at a weight ratio of 25:75 with the $Pt_{0.85}Fe_{0.7}{}_2Co_{0.05}O_2$, produced analogously as in example A, and milled in a centrifugal ball mill for a period until the entire mixture passes through a screen of a mesh width of 1 $\mu$m. 11 g of this intimate mixture of binder and active material are mixed by stirring with 13 g of a mixture of 75 percent by weight water, 23 percent by weight polyglycol and 2 percent by weight tylose. This suspension is spread onto a just etched titanium sheet and is burned-in for 20 minutes at 650° C under an argon atmosphere. Anodes thus prepared so far are working entirely satisfactorily in a laboratory cell for chloroalkali electrolysis according to the diaphragm method at a current density of 1.5 kA/m$^2$.

EXAMPLE 2

50 ml of a mixture of 58.1 vol.% ethanol, 17.4 vol.% trichloroethylene, 12.8 vol.% tetrapropyltitanate and 11.7 vol.% 4-allyl-2-methoxyphenol are intimately mixed by stirring with 1.5 g $Pd_{0.703}Fe_{0.801}O_2$ (see example A). To this suspension are admixed 1.2 g of a compound produced analogously as in example B, of the analysis $K_{0.31}Pt_{0.79}Ta_{0.51}O_{2.59}$, which corresponds to a mixture of $K_{0.4}Pt_3O_4$ with $K_{0.4}TaO_3$ at a ratio Pt:Ta = 3:2. This intimate mixture was applied onto a titanium structure just etched with hot HCl and was burnt-in for 15 minutes at 300 to 400° C.

This structure could be used for several months as anode in a laboratory cell for the electrolysis to produce potassium chlorate without a measurable voltage increase at an anodic current density of $D_A = 3.5$ kA/m$^2$.

EXAMPLE III 20 g NaOH-scales are milled in a ball mill with 10 g palladium sponge and 0.5 g titanium powder and in that regard are intimately mixed. This mixture is heated for seven hours to 350° C. After cooling, it is washed with distilled water until the washings are free of alkali. The dried, extremely absorbent, very finely ground powder is impregnated with $H_2IrCl_6$-solution and is then heated again for one hour to 350° C. The subsequent analysis of the powder corresponded to a preparation $Na_{0.6}Pd_3O_4$ with $Na_{0.6}TiO_3$, wherein the ratio of Pd:Ti = 9:1. Furthermore, an iridium proportion of 10 % of the palladium proportion was found.

16 g of the above obtained preparation are mixed with 3.5 g commercially available rutheniumchloride, 3.6 g titanium oxalate and 1.5 g copper oxalate, which are dissolved in a mixture of 50 % by weight of 10 % oxalic acid, 26 % by weight polyglycol, 21 % by weight of 98 % formic acid and 3 % by weight tylose, and are applied onto a just etched titanium sheet and burnt-in at 400° C. To solidify the thus obtained coating, the titanium sheet was twice immersed again into the solution without solids and was burnt-in at 400° C for 15 minutes each time.

This anode was used in a chloride-containing bath for galvanically depositing platinum for electrical contacts at an anodic current density of $D_A = 1.8$ A/dm$^2$ and is operating fully satisfactorily.

We claim:

1. An electrode for electrochemical processes, particularly for the electrolysis processes for manufacturing chlorine, comprising a metal resistant to the electrolysis medium and an active cover layer bonded thereon selected from the group consisting of:

a. $Pd_xM_yM_zO_2$, wherein M is Fe, Co, Ni, and Mn with $0.7 \leq x < 1$; $0.7 \leq y < 1$ and $0 \leq z \leq 0.1$, and b. $A_xPt_3O_4$, $A_xPd_3O_4$ with one or more substances selected from the group consisting of $A_xTiO_2$, $A_xTiO_3$, $A_xRuO_3$, $A_xRuO_2$, $A_xNbO_3$, and $A_xMnO_2$ wherein A is Li, Na, K, Cu, Ag with $0.3 \leq x \leq 0.7$ and mixtures thereof so that the ratio of the Pt or Pd substance to the other substance is within the range of from about 3:2 to 9:1.

2. An electrode for electrochemical processes, particularly for the electrolysis processes for manufacturing chlorine, consisting of a metal resistant to the electrolysis medium and of an active cover layer bonded thereon and containing the substances causing the electrode process which substances are selected from the group consisting of $Pd_xM_yM_zO_2$, wherein M is Fe, Co, Ni, and Mn with $0.7 \leq x < 1$; $0.7 \leq y < 1$, and $0 \leq z \leq 0.1$ and mixtures thereof.

3. Electrode according to claim 1, in which said cover layer also contains iridium, osmium, rhodium, ruthenium and the oxides thereof, wherein the proportionate amount of said elements always is below the proportionate amount of palladium in the substances.

* * * * *